United States Patent [19]

Collins

[11] 4,025,068

[45] May 24, 1977

[54] SHEET FEEDER

[75] Inventor: Joseph M. Collins, Ontario, N.Y.

[73] Assignee: Xerox Corporation, Stamford, Conn.

[22] Filed: Nov. 21, 1975

[21] Appl. No.: 634,016

[52] U.S. Cl. ..... 271/34; 271/124

[51] Int. Cl.² ..... B65H 3/52

[58] Field of Search ..... 271/34, 35, 122, 125, 271/124

[56] References Cited

UNITED STATES PATENTS

| | | | |
|---|---|---|---|
| 1,866,847 | 7/1932 | Finfrock | 271/35 |
| 2,635,874 | 4/1953 | LaBore | 271/35 |
| 3,469,834 | 9/1969 | Stange | 271/10 |
| 3,768,803 | 10/1973 | Stange | 271/34 |
| 3,831,928 | 8/1974 | Davis | 271/35 |

*Primary Examiner*—Richard A. Schacher

*Attorney, Agent, or Firm*—James J. Ralabate; Clarence A. Green; William A. Henry, II

[57] ABSTRACT

A sheet feeder apparatus having a deformable separator belt and an indexable retard roller includes a device for setting the proper depth of penetration of the retard roller into the deformable belt in the form of a flat surface on the periphery of the roller. In use, a deformable separator belt is placed in the sheet feeder over the flat surface of and adjacent to the retard roller. The proer penetration depth of the retard roller into the deformable belt is subsequently set by indexing the retard roller to present a non-flat surface adjacent the deformable belt.

22 Claims, 2 Drawing Figures

FIG. 1
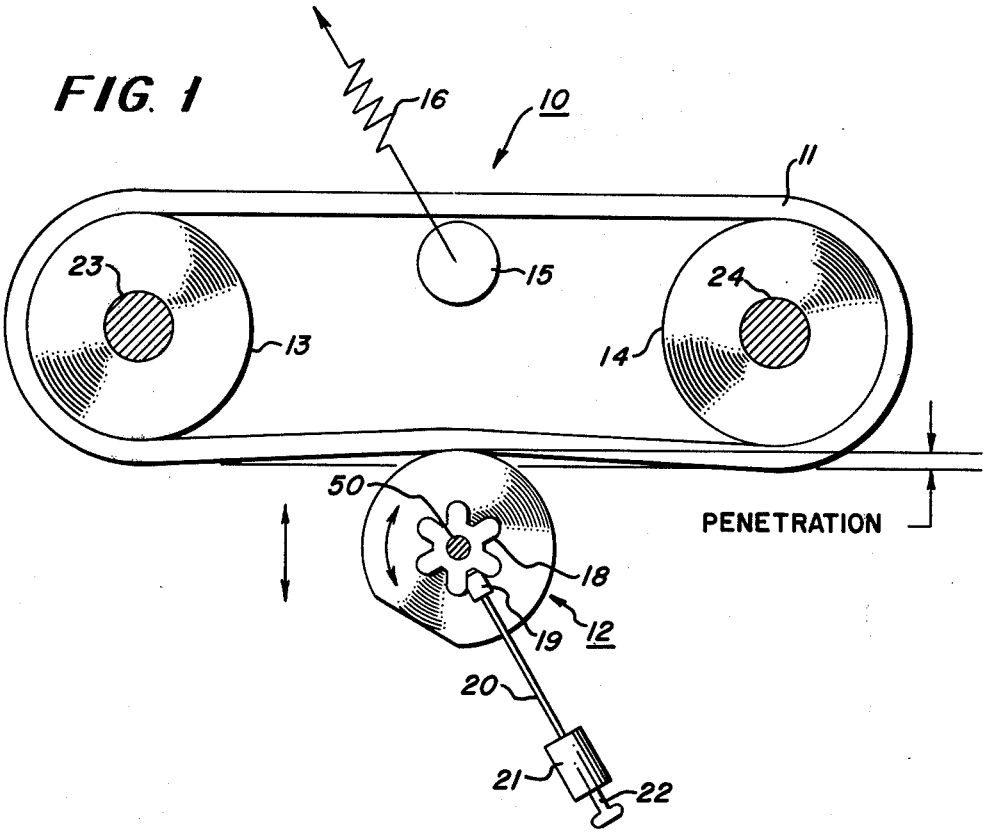
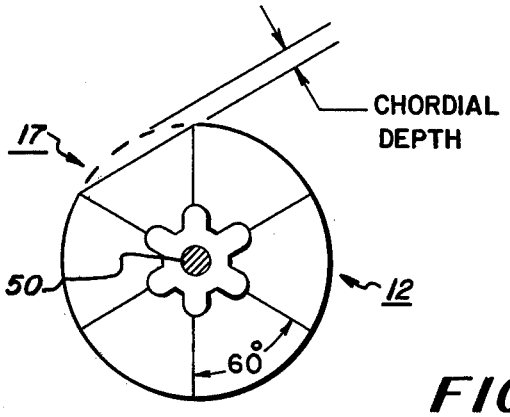
FIG. 2

SHEET FEEDER

BACKGROUND OF THE INVENTION

This invention relates to sheet handling devices and more particularly to a sheet feeder employing a retard means that sets the penetration depth of the retard means into a deformable sheet separator belt.

In the sheet handling art, it has been known to provide a friction roller working in cooperation with a closely spaced deformable separator belt for separating work pieces, usually in the form of sheets, from a stack and forwarding them one at a time to be worked upon. Usually, the retard roller is adjustable to provide for proper handling of sheets of different thicknesses. It sometimes happens due to improper retard roller adjustment, variations of sheet thickness, or more often a combination of both, that a sheet will not be accurately fed and two sheets will be forwarded instead of one. Such an operation is undesirable since it may, for example, impair the efficiency of the following work step or provide, without warning, unacceptable duplicates or cause subsequent machine jams.

Since the penetration depth of the retard roller into the deformable retard belt is critical, adjustments on prior art devices for different sheet thickness and characteristics were tedious, time consuming, and often times inaccurate.

It is, therefore, an object of the present invention to improve said prior art devices by including a means to set the proper penetration depth of a retard roller into a deformable sheet separator belt.

It is another object of this invention to provide an easily adjustable retard means to compensate for different paper characteristics.

A further object of this invention is to provide a method of quickly and easily removing and replacing sheet separator belts.

SUMMARY OF THE INVENTION

In a sheet feeding apparatus that feeds sheets one at a time from a stack of sheets to a work station including a feed member and a retard member adjacent the feed member that is adapted to separate the sheets as they are fed from the stack to the work station, an improvement is disclosed that comprises at least one operative zone on the periphery of the retard member for separating sheets and at least one operative setting zone on its periphery for setting the depth of penetration of the retard member against the feed member when the operative zone is adjacent the feed member. Also, a means for adjusting the retard member adjacent the feed member when the operative setting zone is adjacent the feed member to set the predetermined penetration.

BRIEF DESCRIPTION OF THE DRAWINGS

For a better understanding of the invention as well as other objects and further features thereof, reference is had to the following detailed description of an exemplary embodiment of the invention to be used in conjunction with the accompanying drawings, wherein:

FIG. 1 is a schematic of the invention; and

FIG. 2 is a schematic of the retard roller of the present invention showing a flat surface thereon.

DESCRIPTION OF THE PREFERRED EMBODIMENT

Referring to the drawings, the apparatus of the present invention includes a sheet feeder 10 as shown in FIG. 1. The sheet feeder apparatus 10 is comprised of rollers 13 and 14 having a sheet separator belt 11 mounted thereon for feeding sheets from a stack supported on a platform. The belt can be formed on any suitable material that is stretchable, high friction material, such as rubber. A tension roller 15 is loaded by spring 16 and biased against belt 11 to provide a preselected tension on belt 11 under normal operating conditions.

Rolls 13 and 14 are mounted on stationary axes 23 and 24, respectively, to maintain a desired spacial relationship between paper stacked to be fed and retard roller 12. Alternatively, retard roller 12 can remain stationary and rollers 13 and 14 can be made moveable in order to maintain a desired spacial relationship between the paper to be fed and the retard roller. For a complete description of the relationship between a feed belt, retard means and sheets stacked on a tray, reference may be had to U.S. Pat. No. 3,768,803 commonly assigned with the present invention and hereby incorporated by reference. Other sheet feeders of interest include U.S. Pat. Nos. 2,140,170; 2,140,171; 2,670,954; 3,059,922; 3,070,368; 3,469,834; and 3,612,511.

It is within the operation and design of the retard roller 12 that the present invention resides. As is shown in FIG. 1, retard roller 12 which has a recessed or cutout area integral with and located on the periphery thereof penetrates the proper depth into deformable belt 11 in order to curb misfeed of duplicate sheets to a subsequent machine station. The retard roller is shown eccentrically mounted on shaft or axis 50 for indexable rotation to any of six different positions of 60° each and has a non-uniform radius about axis 50. As the sheets are separated at the junction of the retard roller and the separator belt, there is a tendency for the retard roller to be ground to some radius in the feed direction. The non-flat 60° segments or sections on the periphery of the roller serve as new surfaces to penetrate into deformable belt 11 once the retard roller 12 is indexed to such a section. Each part of a circle or sector of the retard roller could be selectively indexed out of the paper path as indicated by wear or a predetermined maintenance interval. While a retard sector of approximately 60° is recommended for this invention, one could use any size sector desired, for example, 45° sectors could be used. Thus, with 60° sections, six indexing positions are available per roll (that is, $6 \times 60° = 360°$). Only five of these positions are required to cover the projected machine life of some machines, therefore, the sixth index position allows a provision for easy field set-up for proper depth penetration of the retard roller into the deformable belt as well as removal and replacement of the sheet separating belts. Any number of segments could be used and six are mentioned herein only as an example. It should be understood that this invention is usable with bottom feeders also.

The important criteria in a friction retard separator apparatus are the feed belt tension and the retard pad penetration into the feed belt. A spring loaded idler 16, as shown in FIG. 1, supplies belt tension in this particular invention and a "flat" on the sixth index position of the multiple sectional retard roller allows for easy and reliable penetration setting. In order to set the proper depth of penetration of the retard pad against the deformable member 11 to insure feeding of single sheets instead of multiple sheets, the retard pad which has at lease one operative zone or penetrating area on its periphery for separating sheets and at least one operative setting zone or non-penetrating area on its periphery for setting the depth of penetration of the retard pad against the separator 11, is indexed in a clockwise direction until the operative setting zone, which in this embodiment is a flat on the periphery of the retard roller 12 but can be a cut-out area or a recessed area, is adjacent separator 11. From this position a belt or deformable member can be quick and easily taken off over the flat section of the retard pad and easily replaced by sliding a new belt over the recessed area. After these steps are completed, the predetermined proper depth of penetration of the retard roller against the separator 11 is set by indexing with conventional means (not shown) the retard roller or pad to one of the operative zones on its periphery. This newly indexed position on the periphery of the retard roller is the proper penetration setting for single sheet feeding. Once the abrasive surface of the retard roller shows too much wear the roller can be indexed to an unused operative portion thereof.

In order to compensate for different characteristics of substrates to be fed by separator 11, such as, different thicknesses, weights, bonds and stocks, retard member 12 has an adjustable means (not shown since any convention means is appropriate) for adjusting the gap adjacent the retard member and the feed member 10 when the operative setting zone of the retard member is adjacent the feed member to set predetermined penetration of the retard member relative to the feed member. While it was disclosed that the retard member is adjustable relative to the feed member, it should be understood that the separator member 11 could be moved relative to a stationary retard member if one desired. The advantage of this adjustment for different sheet characteristics over prior art devices is the minor adjustment needed. In the apparatus of the present invention the flat on the retard roller is set for standard sheet characteristics, and any adjustment for sheet differences is from that standard.

By setting the retard wheel assembly 10 flush to the feed belt 11 at the flat position on the wheel, and then indexing the wheel to a sector of the usable retard surface, proper depth of penetration of the retard wheel into the deformable belt is fixed. This method of setting the correct penetration of the retard roller into the feed belt has advantages over present devices in that this simple adjustment of penetration depth makes tolerance requirements on both the feed belt and retard pad less stringent. Ease of adjustment of this apparatus to accomplish separation of different types of substrates fed therethrough are obtained by allowing with the use of conventional means (not shown), the retard wheel assembly to move in only one plane, for instance, with that plane being perpendicular to the belt which makes for squareness of the flat surface of the retard wheel to the belt surface. This adjustability allows quick and easy fine tuning at a user's location. A particular user who runs card stock on onion skin paper can peak the feeder performance by adding or subtracting from standard penetration for his particular need.

As can be seen from FIG. 1, a simple and easy method of replacing belt 11 as well as retard roller 12 is disclosed by the use of the flat 17 on retard wheel 12. The retard wheel is manually indexed around ratchet wheel 18 against the bias of pawl 19 and spring 20 that is supported within stationary bar 21. The ratchet wheel is rotated until the flat surface or sector of retard wheel 12 is immediately adjacent belt 11. The belt is effortlessly removed and replaced with a new belt and by simply continuing to index retard roller 11 to a new sector on the surface thereof, the correct penetration depth for proper sheet separation is assured. In order to allow for adjustments for different thicknesses of paper to be separated by roller 12 as they travel between roller 12 and belt 11, the retard roller is adjustable in a vertical plane as viewed in FIG. 1. In order to allow for the adjustment of retard roller 12 in this vertical plane, there is shown in FIG. 1 screw 22 that allows spring 20 as well as pawl 19 to be adjustable within fixed support 21 by turning screw 22 in order for pawl 21 to continue to be seated within ratchet wheel 18 once vertical adjustment is made with the retard roller.

In FIG. 2 there is shown a schematic of roller 12 in the separator of FIG. 1 with flat 17 being disclosed in relation to other usable sections of the roller as well as the predetermined cordial depth of the flat in relation to the periphery of the roller. The retard roller can be made of microcellular form material and the belt can be made of an iosprene material.

Other modifications and variations to the presently disclosed embodiments are possible. All such changes which stay within the spirit of this invention are intended to be encompassed herein.

What is claimed is:

1. In a sheet feeder having a deformable member and a retard member deformably penetrating into the deformable member to separate sheets fed by the deformable member; the improvement comprising: means integral with the periphery of the retard member for setting the proper penetration depth of the retard member into said deformable member.

2. The improvement of claim 1 wherein said means also provides for selectively removing retard member deformation.

3. The improvement of claim 1 wherein said means comprises a flat surface located on the periphery of the retard member that allows said deformable member to assume a substantially non-deformed configuration, said periphery of said retard member being movable relative to said deformable belt.

4. The improvement of claim 1 wherein said retard member is an indexable roller.

5. The improvement of claim 4 wherein said indexable roller has a recessed area on the periphery thereof that is used to obtain the proper penetration of the retard roller into the deformable member.

6. The improvement of claim 4 wherein said indexable roller has an axis of rotation and is eccentric on said axis of rotation.

7. The improvement of claim 4 wherein said indexable roller has an axis of rotation and a non-uniform radius about said axis of rotation.

8. The improvement of claim 1 wherein the retard member is divided into six indexible sections with said means for setting penetration depth of the retard roller into the deformable belt being located on one of the sections.

9. The improvement of claim 8 wherein said means located on one of said sections is a flat surface of a predetermined chordial depth below said periphery.

10. The improvement of claim 1 wherein the retard member is divided into multiple sections.

11. A method of providing clearance to remove a feed member that has a retard member penetrating thereagainst in a sheet feeding apparatus, said retard member having a recessed area thereon; comprising the steps of:

a. rotating said retard member until said recessed area on the periphery thereof is adjacent the feed member surface, thereby providing clearance between the feed member, and the retard member and then, b. removing the feed member over the clearance provided by said recessed area.

12. A method of quick removal and replacement of a deformable belt in a sheet feeder apparatus that includes an indexable retard member having a depth of penetration setting means thereon for setting the proper depth of penetration of the retard member into the deformable belt; comprising the steps of:

a. indexing said retard member to place the depth penetration means thereon adjacent the belt surface, b. removing said deformable belt while said depth penetration is so indexed, c. placing anothe belt in said sheet feeder, and then, d. indexing said retard member to remove said depth of penetration setting means from adjacent the belt surface whereby said indexing causes the proper depth of penetration of the retard member into the deformable belt is set.

13. A method of quick removal of a deformable belt in a sheet feeder apparatus that includes an indexable retard member having a depth of penetration setting means thereon for setting the proper depth of penetration of the retard member into the deformable belt; comprising the steps of:

a. indexing said retard member to place the depth of penetration setting means thereon adjacent the belt surface; and b. removing said deformable belt while said depth penetration is so indexed.

14. In a sheet feeding apparatus wherein sheets are fed one at a time from a stack of sheets to a work station including a feed member and a retard member adjacent the feed member adapted to separate the sheets as they are fed from the stack to the work station; the improvement wherein:

said retard member has at least one operative zone on its periphery for separating sheets and at least one operative setting zone on its periphery for setting the depth of penetration of the retard member against the feed member when said operative zone is adjacent the feed member, and means to adjust the distance between the retard member and the feed member when the operative setting zone is adjacent the feed member to compensate for different sheet thickness.

15. The improvement according to claim 14 wherein said retard member is a retard roller.

16. The improvement of claim 14 wherein said operative setting zone on said retard member is a flat surface.

17. The improvement of claim 14 wherein said retard member includes five operative zones and one operative setting zone for setting the depth of penetration of said retard member into the feed member.

18. In a sheet feeder apparatus having a deformable separator for removing sheets from a stack and a retard pad used to prevent multiple sheet feeding from said stack by proper penetration against said deformable separator, said retard pad being supported for rotation on a stationary support, the improvement comprising:

operative and inoperative zones located on the periphery of said retard pad with said operative zone being for penetrating against the deformable separator and said inoperative zone allowing for non-penetration into said deformable separator.

19. The improvement of claim 18 wherein said inoperative zone is a recessed area on the periphery of said retard pad.

20. The improvement of claim 19 wherein said recessed area is a flat surface on the periphery of said retard pad.

21. In a sheet feeding apparatus wherein sheets are fed one at a time from a stack of sheets to a work station including a feed member and a retard pad having multiple sections thereon adjacent the feed member adapted to separate the sheets as they are fed from the stack to the work station; the improvement comprising:

a recessed means as one of said sections for setting the proper depth of penetration of said retard pad against the feed member, and means to adjust the retard pad relative to said feed member in order to compensate for different sheet characteristics.

22. In a sheet feeding apparatus wherein sheets are fed one at a time from a stack of sheets to a work station including a feed member and a retard pad having multiple sections thereon adjacent the feed member adapted to separate the sheets as they are fed from the stack to the work station; the improvement comprising:

a recessed means as one of said sections for setting the proper depth of penetration of said retard pad against the feed member, and means for adjusting the feed member relative to the retard pad in order to compensate for different sheet characteristics.

* * * * *